US009297271B2

(12) United States Patent
Hafner

(10) Patent No.: US 9,297,271 B2
(45) Date of Patent: Mar. 29, 2016

(54) TURBINE BLADE MONITORING ARRANGEMENT AND METHOD OF MANUFACTURING

(71) Applicant: General Electric Company, Schenectady, NY (US)

(72) Inventor: Matthew Troy Hafner, Honea Path, SC (US)

(73) Assignee: General Electric Company, Schenectady, NY (US)

( * ) Notice: Subject to any disclaimer, the term of this patent is extended or adjusted under 35 U.S.C. 154(b) by 556 days.

(21) Appl. No.: 13/872,657

(22) Filed: Apr. 29, 2013

(65) Prior Publication Data

US 2014/0321982 A1 Oct. 30, 2014

(51) Int. Cl.
*F01D 25/00* (2006.01)
*F01D 17/08* (2006.01)
*F01D 11/20* (2006.01)

(52) U.S. Cl.
CPC ..... *F01D 17/08* (2013.01); *F01D 11/20* (2013.01); *Y10T 29/49316* (2015.01)

(58) Field of Classification Search
CPC ..... F01D 11/20; F01D 17/08; F01D 11/08; F01D 11/14; F01D 25/24; F01D 17/02; F01D 17/085; F01D 21/04; F01D 21/12; F01D 21/14; F01D 21/003; F05D 2240/11; F05D 2270/80; F05D 2270/804; F05D 2260/83; F05D 2270/821
USPC ..... 415/14, 118; 416/61; 73/112.03, 73/112.01, 112.05
See application file for complete search history.

(56) References Cited

U.S. PATENT DOCUMENTS

| | | | | |
|---|---|---|---|---|
| 3,272,174 | A * | 9/1966 | Pribonic | G01F 23/2928 116/202 |
| 4,049,349 | A | 9/1977 | Wennerstrom | |
| 6,401,460 | B1 * | 6/2002 | Xia | F01D 11/24 415/14 |
| 6,607,350 | B2 | 8/2003 | Dodd | |
| 7,215,129 | B1 | 5/2007 | Andarawis et al. | |
| 8,230,726 | B2 | 7/2012 | Hafner | |
| 2001/0013582 | A1 * | 8/2001 | Johnson | F01D 11/08 250/559.29 |
| 2011/0194122 | A1 * | 8/2011 | Heyworth | F01D 11/14 356/615 |

* cited by examiner

*Primary Examiner* — Edward Look
*Assistant Examiner* — Jason Mikus
(74) *Attorney, Agent, or Firm* — Ernest G. Cusick; Frank A. Landgraff

(57) ABSTRACT

A turbine blade monitoring arrangement includes a bucket tip located at a radial outer location of a bucket. Also included is at least one component disposed radially outwardly of the bucket tip. Further included is a hollow portion of the at least one component, wherein the hollow portion extends radially from a first end to a second end through the at least one component. Yet further included is a first sealing component operatively coupled to the at least one component proximate the first end of the hollow portion, wherein the first sealing component comprises a translucent material. Also included is a proximity sensor disposed radially outwardly of the at least one component and aligned with the hollow portion, the proximity sensor configured to generate a first signal through the hollow portion to the bucket tip.

20 Claims, 6 Drawing Sheets

TURBINE BLADE MONITORING ARRANGEMENT AND METHOD OF MANUFACTURING

BACKGROUND OF THE INVENTION

The subject matter disclosed herein relates to turbine systems, and more particularly to a turbine blade monitoring arrangement, as well as a method of manufacturing the turbine blade monitoring arrangement.

Efficiency of a gas turbine engine is impacted by clearance between an outer radial tip of rotor blades and the surrounding stationary structure, which is referred to herein as "tip clearance." Tighter clearances decrease the leakage flow around the rotor blades, which improves engine efficiency. However, tighter tip clearances increase the risk that rotating parts will make contact with or rub against non-rotating parts during one of the engine's several operational modes, particularly considering that tip clearances generally vary based upon operating conditions. Primarily, this is due to the different thermal expansion characteristics of many of the engine components. Of course, having rotating and stationary parts rub or make contact during operation is typically undesirable because it may adversely affect various components or operating modes. In addition, rubbing may result in increased clearances once the event that caused the rubbing passes. On the other hand, the engine may be designed with more open clearances that decrease the likelihood of rubbing parts. However, this is undesirable because it generally allows for more leakage and thereby decreases the efficiency of the engine.

Maintenance of a gas turbine engine is generally planned around specific operation of the engine, as recorded in number of starts and hours of operation. Sensors could be employed to measure the condition of the gas turbine components to determine when maintenance is required based on a measured hardware condition. Creep of turbine hardware over time is an indicator of when hardware maintenance is required. Turbine hardware condition could be used to delay planned maintenance or schedule maintenance earlier to prevent a possible failure.

Gas turbine engines may employ active clearance control systems to manage the clearance during a myriad of operating conditions so that a tight, non-rubbing clearance is maintained. It will be appreciated that these systems need regular, updated, and accurate tip clearance data to realize the full benefit of the clearance control system. Conventional measurement systems measure tip clearance with proximity sensors positioned in the hot-gas path. Typically, these probes are positioned directly over the rotor blades and measure the distance between the probe and the blade tips of the rotor blades as the blades pass. The downside of positioning the sensors in this manner is that the sensors are exposed to the extreme temperatures of the hot gas path. Sensors that are able to withstand these conditions while providing accurate measurements are expensive. Even so, because of the extreme conditions of the hot-gas path, these sensors can have short lifespans, which increase costs and maintenance requirements. Also, these sensors typically require a supply of cooling air, which may be bled from the compressor or supplied from an auxiliary source. It will be appreciated that providing cooling air in this manner adds complexity to engine systems and decreases the efficiency of the engine.

As an alternative to positioning the sensors within the hot gas path, sensors may be positioned in remote locations outside of the hot gas path to measure distances to other turbine components. These measurements are then employed to estimate tip clearance indirectly based on calculations employing the mechanical and thermal displacements of the relevant turbine components and measurement data.

BRIEF DESCRIPTION OF THE INVENTION

According to one aspect of the invention, a turbine blade monitoring arrangement for monitoring tip clearance and turbine blade creep includes a bucket tip located at a radial outer location of a bucket. Also included is at least one component disposed radially outwardly of the bucket tip. Further included is a hollow portion of the at least one component, wherein the hollow portion extends radially from a first end to a second end through the at least one component. Yet further included is a first sealing component operatively coupled to the at least one component proximate the first end of the hollow portion, wherein the first sealing component comprises a translucent material. Also included is a proximity sensor disposed radially outwardly of the at least one component and aligned with the hollow portion, the proximity sensor configured to generate a first signal through the hollow portion to the bucket tip.

According to another aspect of the invention, a turbine blade monitoring arrangement for monitoring tip clearance and turbine blade creep includes a bucket tip located at a radial outer location of a bucket. Also included is a shroud disposed proximate the bucket tip, the shroud having a first hollow portion extending radially from a first end to a second end through the shroud. Further included is a turbine shell disposed radially outwardly of the shroud, the turbine shell having a second hollow portion extending radially through the turbine shell. Yet further included is a first sealing component operatively coupled to the shroud proximate the first end of the first hollow portion, wherein the first sealing component comprises a translucent material. Also included is a proximity sensor disposed outside of the turbine shell and configured to generate a first signal through the first hollow portion and the second hollow portion to the bucket tip.

According to yet another aspect of the invention, a method of manufacturing a turbine blade monitoring arrangement is provided. The method includes hollowing a first hollow portion of at least one component. The method also includes operatively coupling a sealing component to the at least one component proximate a first end of the hollow portion, wherein the sealing component comprises a translucent material. The method further includes disposing the at least one component radially outwardly of, and in close proximity to, a bucket tip. The method yet further includes disposing a proximity sensor radially outwardly of the at least one component. The method also includes aligning the proximity sensor with the hollow portion for generating a signal through the hollow portion to the bucket tip.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
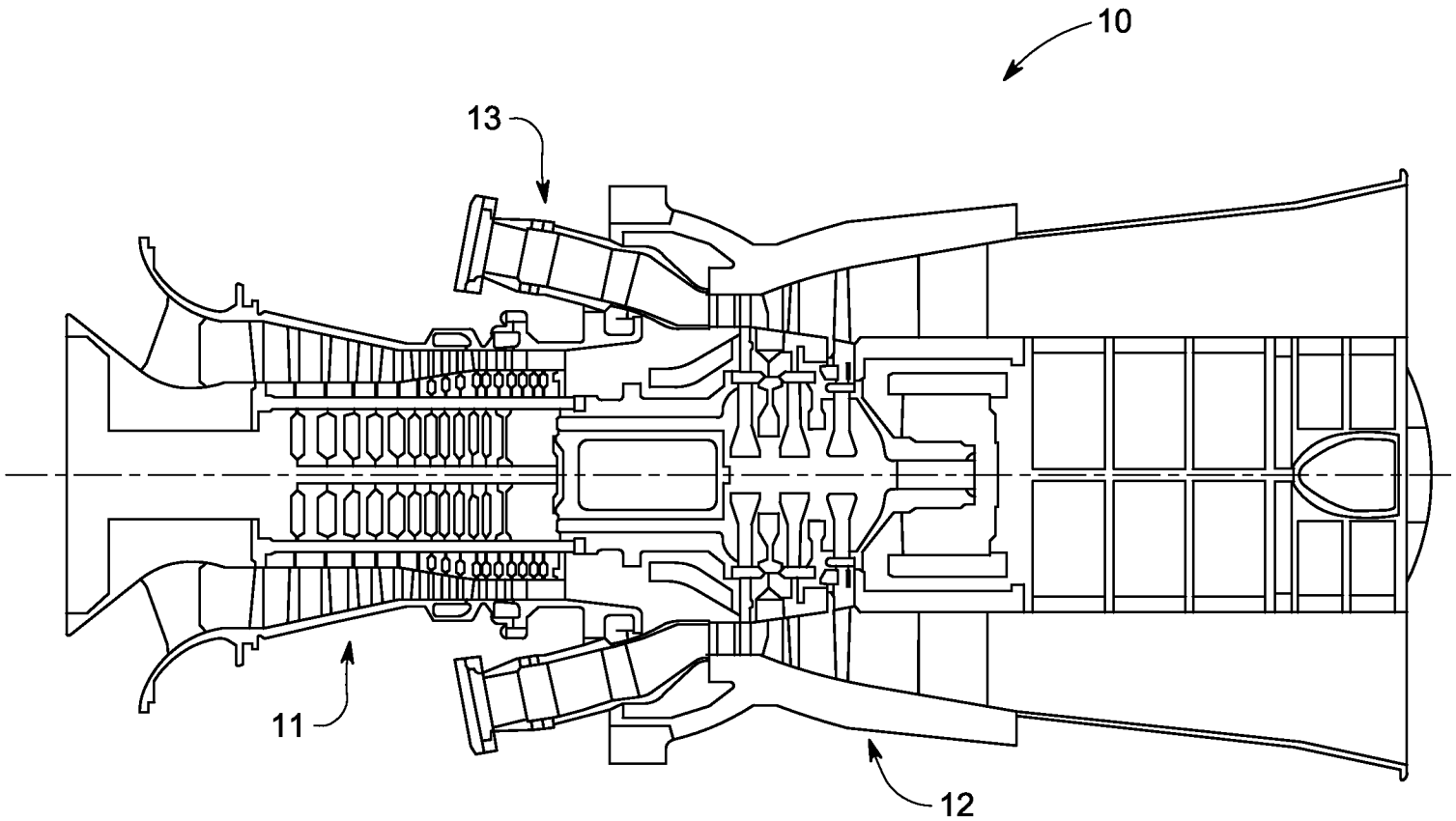
FIG. 1 is a schematic illustration of a turbine system.

Referring to FIG. 1, an exemplary embodiment of a turbine system, such as a gas turbine engine 10, is generally illustrated. It will be understood by those skilled in the art that the embodiments described herein are not limited to this type of system. Specifically, in addition to the gas turbine engine 10, other specific embodiments include those gas turbine engines used in airplanes, steam turbine engines, and other type of rotary engines. In general, the gas turbine engine 10 operates by extracting energy from a pressurized flow of hot gas produced by the combustion of a fuel in a stream of compressed air. The gas turbine engine 10 may be configured with a compressor 11 that is mechanically coupled by a common shaft or rotor to a downstream turbine section or a turbine 12, and a combustor 13 positioned between the compressor 11 and the turbine 12.

Figure 2:
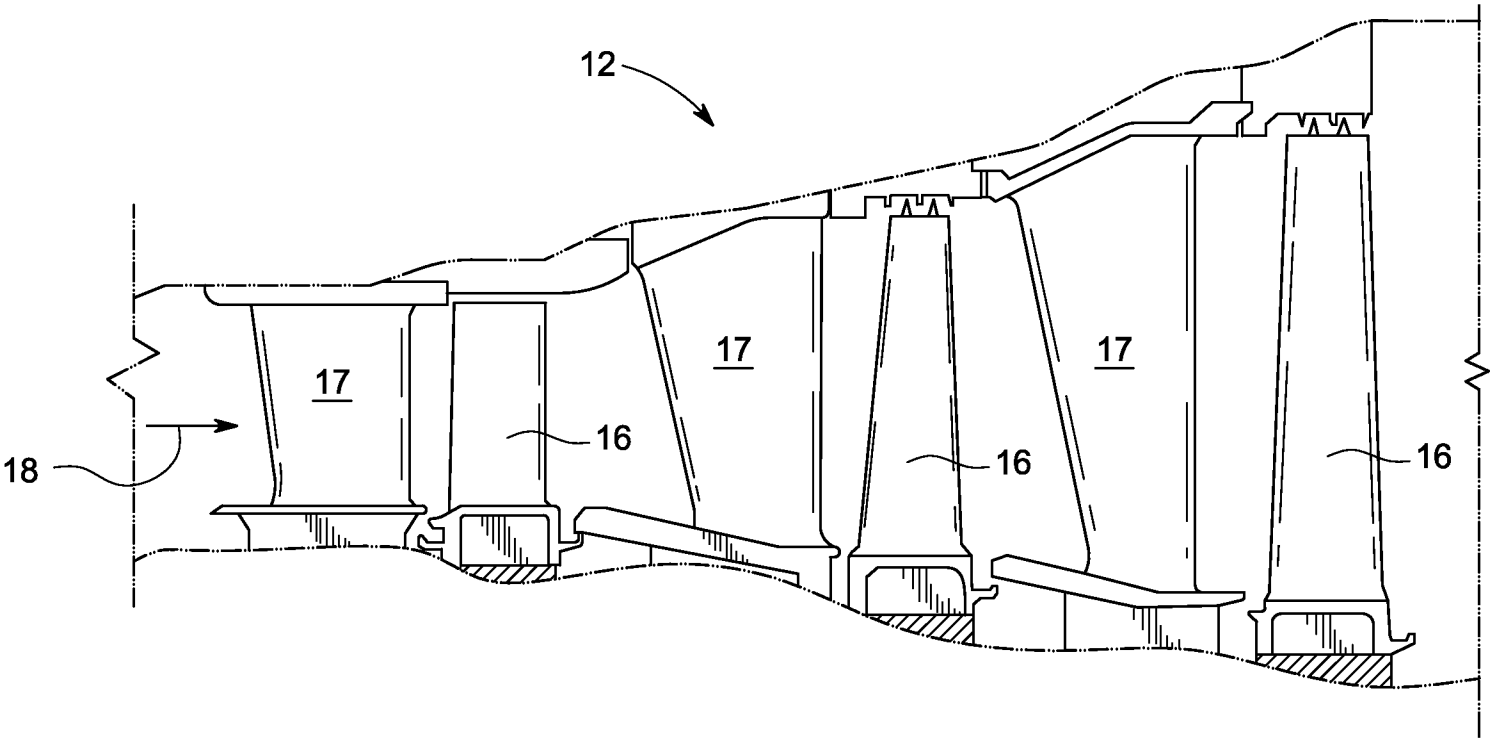
FIG. 2 is a sectional view of a turbine section of the turbine system.

Referring now to FIG. 2, the turbine 12 that may be used in the gas turbine engine 10 of FIG. 1 is illustrated as a multistage axial turbine. Three exemplary stages are illustrated, but more or less stages may be present in the turbine 12. Each stage includes a plurality of turbine rotor blades, or turbine buckets 16, which rotate about the shaft during operation, and a plurality of nozzles or turbine stator blades 17, which remain stationary during operation. The turbine stator blades 17 generally are circumferentially spaced from each other and fixed about the axis of rotation. The turbine buckets 16 may be mounted on a turbine wheel (not shown) for rotation about the shaft (not shown). It will be appreciated that the turbine stator blades 17 and the turbine buckets 16 lie in the hot-gas path of the turbine 12. The direction of flow of the hot gases through the hot-gas path is indicated by arrow 18. As one of ordinary skill in the art will appreciate, the turbine 12 may have other stages beyond the stages that are illustrated. Each additional stage may include a row of turbine stator blades 17 followed by a row of the turbine buckets 16.

In operation, the compressor 11 may compress a flow of air. In the combustor 13, energy may be released when the compressed air is mixed with a fuel and ignited. The resulting flow of hot gases from the combustor 13, which may be referred to as the working fluid, is then directed over the turbine buckets 16, the flow of working fluid inducing the rotation of the turbine buckets 16 about the shaft. Thereby, the energy of the flow of working fluid is transformed into the mechanical energy of the rotating blades and, because of the connection between the rotor blades and the shaft, the rotating shaft. The mechanical energy of the shaft may then be used to drive the rotation of compressor blades, such that the necessary supply of compressed air is produced and also, for example, a generator to produce electricity.

Figure 3:
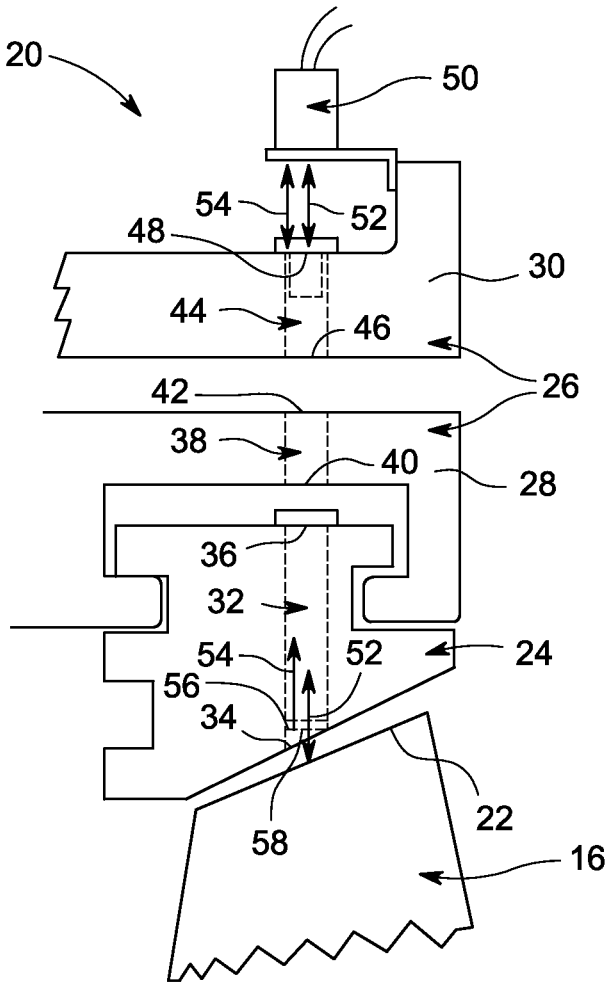
FIG. 3 is an elevation view of a turbine blade monitoring system in a first operational mode.

Referring now to FIG. 3, a turbine blade monitoring arrangement 20 is illustrated. The turbine blade monitoring arrangement 20 may be employed to determine tip clearance as the gas turbine engine 10 operates. Additionally "creep" of the turbine bucket 16 over its lifespan may be monitored. As shown, the turbine bucket 16 includes a bucket tip 22 located at a radial outer location in close proximity to at least one component disposed radially outwardly of the bucket tip 22. The at least one component refers to numerous contemplated turbine components and in one embodiment, the at least one component is a shroud 24 that is fixed in a stationary position. The shroud 24 may be fixed to a turbine shell 26, which is located primarily radially outwardly of the shroud 24. The turbine shell 26 may be a single shell structure or may be segmented into an inner turbine shell 28 and an outer turbine shell 30.

The shroud 24 includes a first hollow portion 32 extending therethrough. The first hollow portion 32 extends radially throughout the shroud 24 from a first end 34 to a second end 36. Similarly, the turbine shell 26 includes a hollow portion extending radially therethrough. In the case of the turbine shell 26 comprising the inner turbine shell 28 and the outer turbine shell 30, the inner turbine shell 28 includes a second hollow portion 38 extending radially from a third end 40 to a fourth end 42. The outer turbine shell 30 includes a third hollow portion 44 extending radially from a fifth end 46 to a sixth end 48.

The respective hollow portions are aligned to allow a signal generated from a proximity sensor 50 to pass through the hollow portions. It is contemplated that more than one proximity sensor is included at one or more locations of the turbine 12. The proximity sensor 50 is fixed proximate a radially outer location of the turbine shell 26, and more particularly the outer turbine shell 30 in such an embodiment. The proximity sensor 50 may be operatively coupled to the outer turbine shell 30, as shown in the illustrated embodiment. The proximity sensor 50 is aimed toward one or more target surfaces. In the illustrated operating mode (i.e., first operational mode), a first signal 52 is generated and aimed toward the bucket tip 22 and a second signal 54 is generated and aimed toward a shroud target 56, such as a land on the shroud 24. The first signal 52 facilitates detection by the proximity sensor 50 of a first distance, namely the distance between the proximity sensor 50 to the bucket tip 22. The second signal 54 facilitates detection by the proximity sensor 50 of a second distance, namely the distance between the proximity sensor and a predetermined location of the shroud 24, and more particularly a radially inward location of the shroud 24. Based on a known thickness of a segment of the shroud 24 proximate the shroud target 56, the tip clearance between the bucket tip 22 and the shroud 24 is calculated. Specifically, the difference between the distances detected by the first signal 52 and the second signal 54, with the known segment thickness accounted for, determines the tip clearance.

A seal component 58 is disposed proximate, and at least partially within, the first end 34 of the first hollow portion 32. The seal component 58 effectively seals the shroud 24 to reduce leakage of the working fluid passing through the hot gas path and to reduce leakage of cooling air into the hot gas path. The seal component 58 is formed of a translucent or transparent material that allows the first signal 52 and the second signal 54 to pass through the seal component 58 toward the intended target of the respective signals. Any translucent or transparent material is contemplated, but in exemplary embodiments the material suitably withstands high temperatures to avoid malfunction or short lifespan of the seal component 58. In one exemplary embodiment, the material comprises mica. In addition to the first end 34 of the first hollow portion 32, similar seal components may be disposed proximate other locations of the hollow portions. Specifically, the seal component 58 may be located proximate the second end 36 of the first hollow portion 32, the third end 40 and the fourth end 42 of the second hollow portion 38, as well as the fifth end 46 and the sixth end 48 of the third hollow portion 44.

Figure 4:
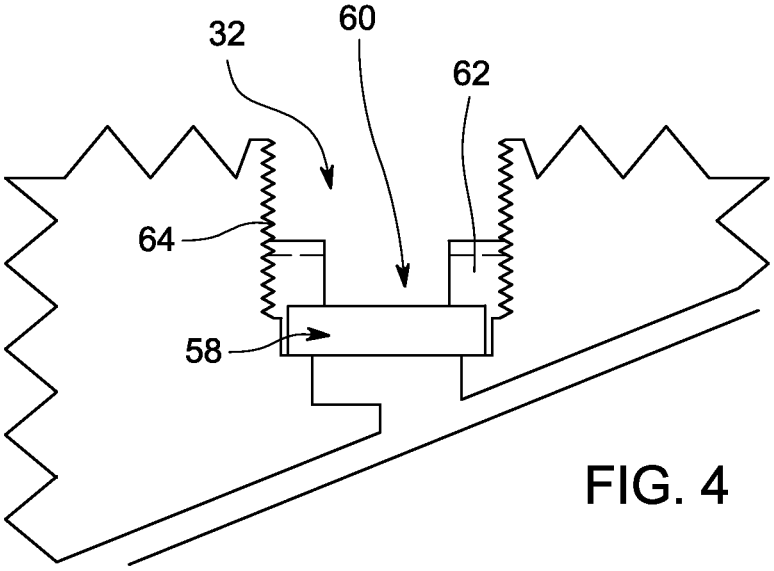
FIG. 4 is an enlarged view of a sealing component of the turbine blade monitoring system.
Figure 5:
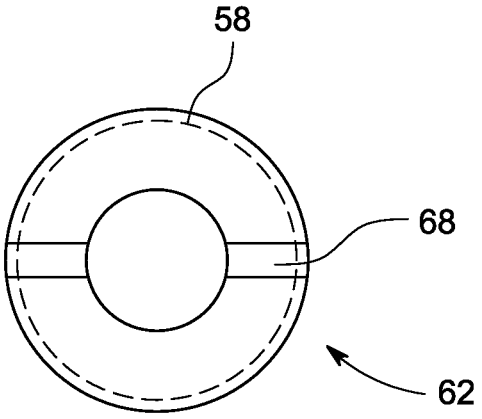
FIG. 5 is a top plan view of an engagement component for securing the sealing component.

Referring to FIGS. 4 and 5, the seal component 58 is illustrated in greater detail. As shown, the seal component 58 is placed in a bore region 60 of the first end 34 of the first hollow portion 32 of the shroud 24. The seal component 58 may be operatively coupled to the shroud 24 in several contemplated manners, and in one embodiment, a mechanical fastener 62, such as a nut, may be used to secure the seal component 58. In the illustrated embodiment, the mechanical fastener 62 engages a threaded portion 64 of the first hollow portion 32 to tightly secure the seal component 58 in a fixed position. Although the first end 34 of the first hollow portion 32 has been described in detail, a similar operative coupling may be included at other locations of the first hollow portion 32, the second hollow portion 38, and/or the third hollow portion 44. To facilitate installation ease, the mechanical fastener 62 may include a slot 68 configured to receive a fastening tool.

Figure 6:
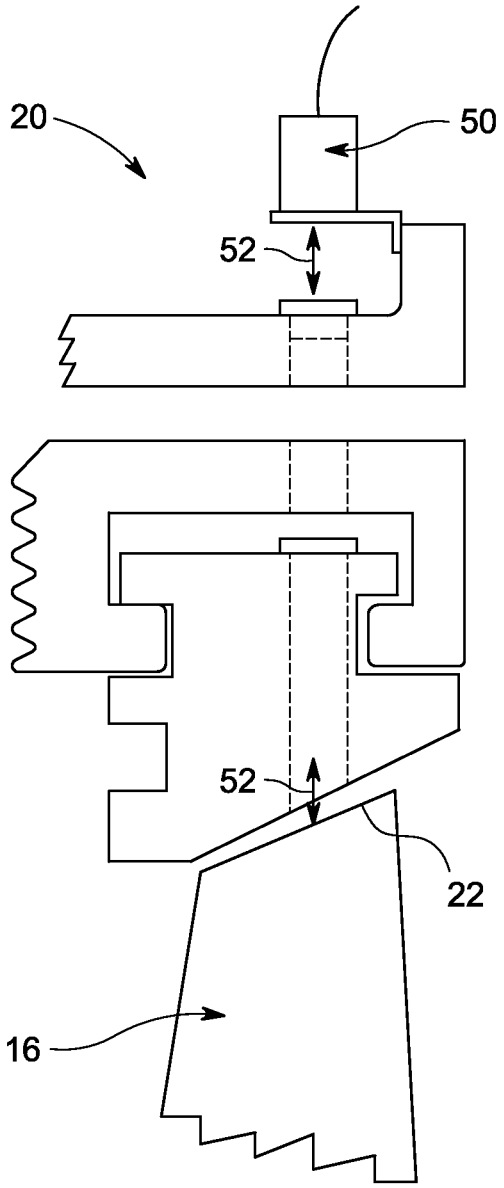
FIG. 6 is an elevation view of the turbine blade monitoring system in a second operational mode.

Referring to FIG. 6, the turbine blade monitoring arrangement 20 is illustrated in a second operational mode. In the illustrated operating mode, the proximity sensor 50 only generates the first signal 52 through the hollow portions to the bucket tip 22. Measurement of this distance along provides the collection of measurement data to determine creep of the turbine bucket 16 over time. Comparing the measurements to past data allows monitoring of creep in various operating conditions.

Figure 7:
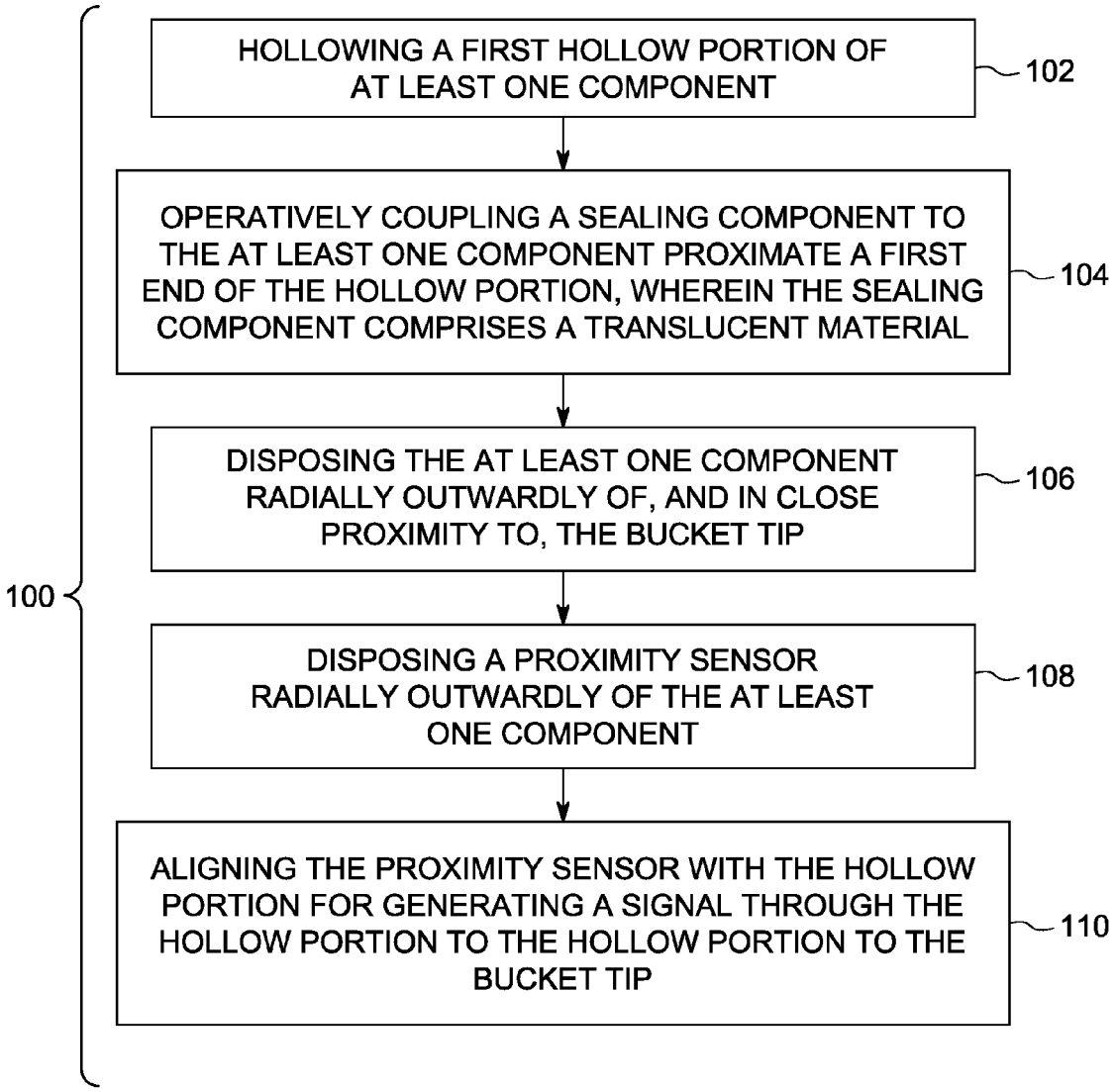
FIG. 7 is a flow diagram illustrating a method of manufacturing a turbine blade monitoring arrangement.

As illustrated in the flow diagram of FIG. 7, and with reference to FIGS. 1-6, a method of manufacturing a turbine blade monitoring arrangement 100 is also provided. The gas turbine engine 10, as well as the turbine blade monitoring arrangement 20, has been previously described and specific structural components need not be described in further detail. The method of manufacturing a turbine blade monitoring arrangement 100 includes hollowing a first hollow portion of at least one component 102. The sealing component 58 is operatively coupled to the at least one component proximate a first end of the hollow portion, wherein the sealing component comprises a translucent material 104. The at least one component is disposed radially outwardly of, and in close proximity to, a bucket tip 106. The proximity sensor 50 is disposed radially outward of the at least one component 108 and the proximity sensor 50 is aligned with the hollow portion for generating a signal through the hollow portion to the bucket tip 110.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine blade monitoring arrangement for monitoring tip clearance and turbine blade creep comprising:

a bucket tip located at a radial outer location of a bucket;

at least one component disposed radially outwardly of the bucket tip;

a hollow portion of the at least one component, wherein the hollow portion extends radially from a first end to a second end through the at least one component;

a first sealing component operatively coupled to the at least one component proximate the first end of the hollow portion, wherein the first sealing component comprises a translucent material; and a proximity sensor disposed outwardly of the at least one component configured to generate a first signal through the hollow portion to the bucket tip.

2. The turbine blade monitoring arrangement of claim 1, wherein the translucent material comprises mica.

3. The turbine blade monitoring arrangement of claim 1, wherein the first sealing component is mechanically fastened to the at least one component.

4. The turbine blade monitoring arrangement of claim 1, further comprising a second sealing component operatively coupled to the at least one component proximate the second end of the hollow portion, wherein the second sealing component comprises the translucent material.

5. The turbine blade monitoring arrangement of claim 1, further comprising:

a threaded portion of the hollow portion; and a mechanical fastener engaged to the threaded portion for fixedly securing the first sealing component to the at least one component.

6. The turbine blade monitoring arrangement of claim 1, wherein the at least one component comprises a shroud, a turbine shell or a combination thereof.

7. The turbine blade monitoring arrangement of claim 6, wherein the proximity sensor is operatively coupled to a radially outer location of the turbine shell.

8. The turbine blade monitoring arrangement of claim 6, wherein the proximity sensor is configured to generate a second signal through the hollow portion to the at least one component, wherein the first signal and the second signal facilitate calculation of a tip clearance.

9. The turbine blade monitoring arrangement of claim 1, wherein the first signal monitors creep of the bucket.

10. A turbine blade monitoring arrangement for monitoring tip clearance and turbine blade creep comprising:

a bucket tip located at a radial outer location of a bucket;

a shroud disposed proximate the bucket tip, the shroud having a first hollow portion extending radially from a first end to a second end through the shroud;

a turbine shell disposed radially outwardly of the shroud, the turbine shell having a second hollow portion extending radially through the turbine shell;

a first sealing component operatively coupled to the shroud proximate the first end of the first hollow portion, wherein the first sealing component comprises a translucent material; and a proximity sensor disposed outside of the turbine shell and configured to generate a first signal through the first hollow portion and the second hollow portion to the bucket tip.

11. The turbine blade monitoring arrangement of claim 10, wherein the translucent material comprises mica.

12. The turbine blade monitoring arrangement of claim 10, further comprising a second sealing component operatively coupled to the shroud proximate the second end of the first hollow portion, wherein the second sealing component comprises the translucent material.

13. The turbine blade monitoring arrangement of claim 10, further comprising:

a threaded portion of the first hollow portion; and a mechanical fastener engaged to the threaded portion for fixedly securing the first sealing component to the shroud.

14. The turbine blade monitoring arrangement of claim 10, wherein the proximity sensor is operatively coupled to a radially outer location of the turbine shell.

15. The turbine blade monitoring arrangement of claim 10, wherein the turbine shell comprises an inner turbine shell and an outer turbine shell, the second hollow portion extending through the inner turbine shell, and wherein the outer turbine shell comprises a third hollow portion extending radially therethrough.

16. The turbine blade monitoring arrangement of claim 10, further comprising:

a third sealing component operatively coupled to the turbine shell proximate a third end of the second hollow portion, wherein the third sealing component comprises the translucent material; and a fourth sealing component operatively coupled to the turbine shell proximate a fourth end of the second hollow portion, wherein the fourth sealing component comprises the translucent material.

17. The turbine blade monitoring arrangement of claim 10, wherein the proximity sensor is configured to generate a second signal through the first hollow portion to the bucket tip and the second hollow portion to a land on the shroud, wherein the first signal and the second signal facilitate calculation of a tip clearance.

18. The turbine blade monitoring arrangement of claim 10, wherein the first signal monitors creep of the bucket.

19. A method of manufacturing a turbine blade monitoring arrangement comprising:

hollowing a first hollow portion of at least one component;

operatively coupling a sealing component to the at least one component proximate a first end of the hollow portion, wherein the sealing component comprises a translucent material;

disposing the at least one component radially outwardly of, and in close proximity to, a bucket tip;

disposing a proximity sensor radially outwardly of the at least one component; and aligning the proximity sensor with the hollow portion for generating a signal through the hollow portion to the bucket tip.

20. The method of claim 19, wherein disposing the proximity sensor comprises operatively coupling the proximity sensor at a radially outward location of a turbine shell.

* * * * *